United States Patent [19]

Schoeffler

[11] 4,408,670

[45] Oct. 11, 1983

[54] IMPACT CAM SUBASSEMBLY FOR DRILLS

[76] Inventor: William N. Schoeffler, 3600 E. Simcoe, Apt. 8, Lafayette, La. 70501

[21] Appl. No.: 257,366

[22] Filed: Apr. 24, 1981

[51] Int. Cl.[3] ..... E21B 4/10

[52] U.S. Cl. ..... 175/298; 175/306; 175/325

[58] Field of Search ..... 175/298, 299, 305, 306, 175/322, 325, 61, 320; 173/94, 123

[56] References Cited

U.S. PATENT DOCUMENTS

| | | | |
|---|---|---|---|
| 1,745,351 | 2/1930 | Bishop | 175/298 |
| 1,747,020 | 2/1930 | Church et al. | 175/306 |
| 2,425,012 | 3/1944 | Snyder | 175/299 |
| 2,495,364 | 1/1950 | Clapp | 173/95 |
| 2,742,264 | 4/1956 | Snyder | 175/299 |
| 2,742,265 | 4/1956 | Snyder | 175/299 |
| 3,163,237 | 12/1964 | Fulop | 173/123 |
| 3,268,014 | 8/1966 | Drew | 173/97 |
| 3,389,756 | 6/1968 | Kawamoto | 173/97 |
| 4,082,151 | 4/1978 | Finney | 173/123 |
| 4,163,478 | 8/1979 | Adcock | 175/325 |

FOREIGN PATENT DOCUMENTS

| | | | |
|---|---|---|---|
| 709308 | 1/1952 | United Kingdom | 175/298 |
| 725175 | 3/1955 | United Kingdom | 175/298 |

*Primary Examiner*—Stephen J. Novosad
*Assistant Examiner*—William P. Neuder
*Attorney, Agent, or Firm*—Thomas S. Keaty

[57] ABSTRACT

A sub assembly to be inserted between a drill string and a bit has a stabilizer sleeve to engage the walls of a bore hole and hold a first cam against rotation. A second cam is fixed to a drill holder at the lower end of the assembly and is driven in rotation by a rotary driving member extending through the assembly. The cams interengage so that relative rotation between them applies periodic impacts to the drill holder.

7 Claims, 6 Drawing Figures

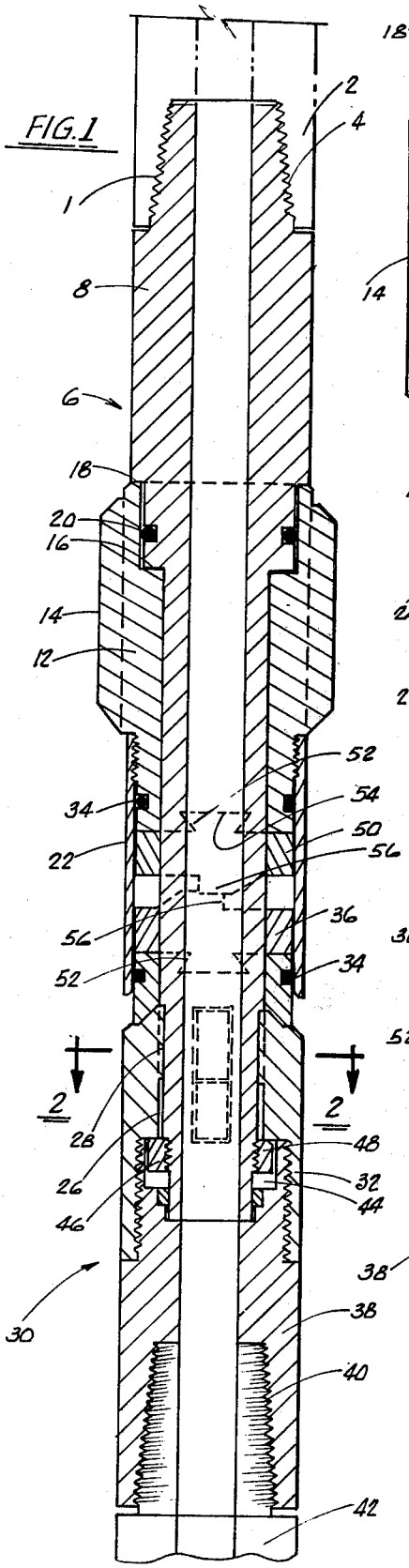
FIG. 1
1
2
4
8
6
18
20
16
14
12
52
54
50
56
34
22
36
2
2
28
26
46
48
32
44
30
38
40
42
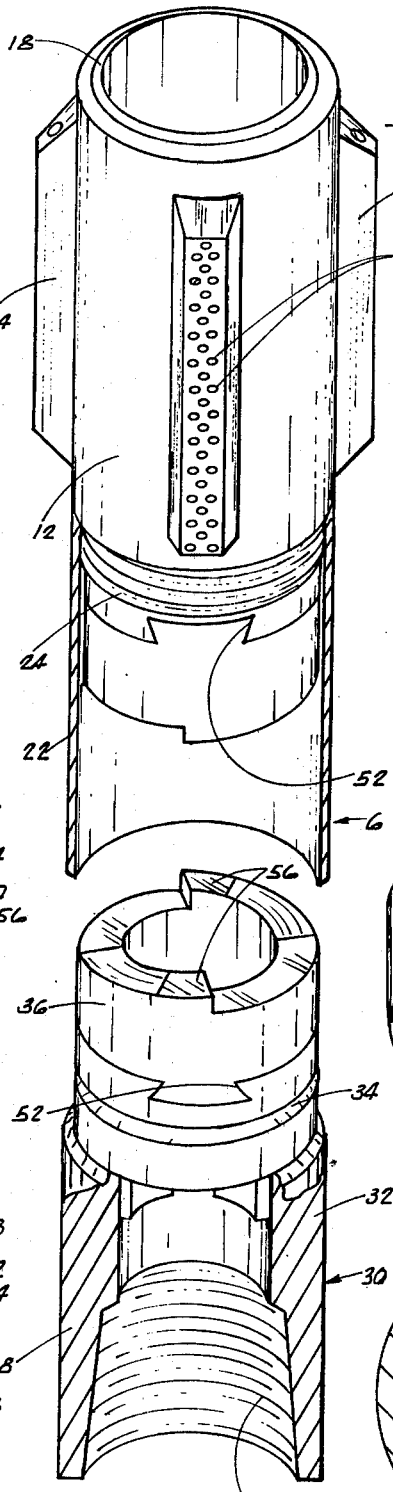
FIG. 3
18
14
15
14
12
24
22
52
6
56
36
52
34
32
30
38
40
FIG. 4
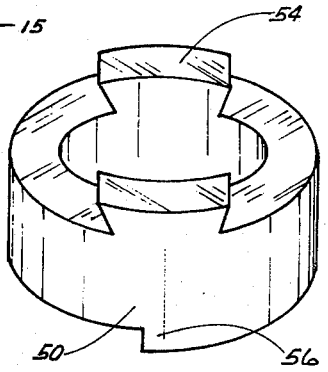
54
50
56
FIG. 5
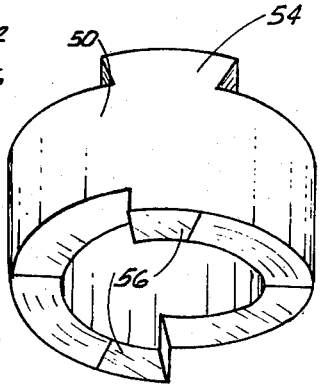
50
54
56
FIG. 6
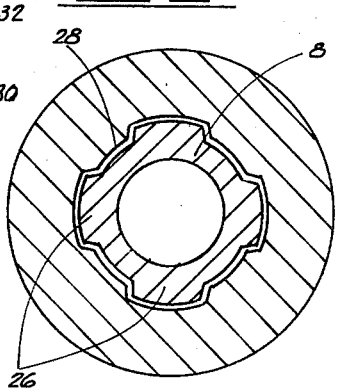
28
8
26
FIG. 2

IMPACT CAM SUBASSEMBLY FOR DRILLS

BACKGROUND OF THE INVENTION

This invention is in the field of impacting devices for drill bits.

It has been known to provide means for periodically impacting a drill bit at the bottom of a well to assist in cutting the earth formation. See, for example, the patents to Grant et al., U.S. Pat. No. 1,748,341, Snyder, U.S. Pat. No. 2,742,265, and Stilley, U.S. Pat. No. 2,400,853. In the Grant patent a multiplicity of drill chisels are vertically slidable in a holder rotatable relative to the drill string. A cam on the drill string periodically lifts the chisels one at a time, and springs then urge the chisel downwardly to impact the earth formation. The chisel holder is held against rotation by the chisel bits that remain in contact with the well bottom.

The patent to Snyder employs a separate hammer rotatable and slidable on a rotary driver and has vanes to resist rotation as the drill string rotates. The hammer is provided with a cam engageable with a cam carried by the rotatable driver and which periodically lifts the hammer, then drops the same onto the drill bit.

The patent to Stilley employs a plurality of chisel bits or blades vertically slidable and spring pressed upwardly against a cam driven by a turbine in a housing at the bottom of the drill string. Thus, the turbine periodically projects the drill chisel downwardly against the formation to facilitate drilling.

SUMMARY OF THE INVENTION

The present invention comprises a sub assembly adapted to be inserted in a drill string, preferably directly above the drill bit and operable by rotation of the drill string to produce periodic impacts on the drill to facilitate cutting the earth formation, but wherein excessive weight on the drill is avoided. In general, the sub assembly comprises a driving member adapted to be fixed to the bottom of a drill string and having a drill holder at its lower end that is vertically slidable along the driving member but splined thereto so that it cannot rotate independently. An intermediate portion of the assembly carries a fixed cam and has means engageable with the sides of the well bore to hold it against rotation. A second cam, on the drill holder, cooperates with the first cam to periodically lift the last mentioned portion of the assembly and thereby exert upward pressure on the drill string. At a point in its rotation, the cam pass a "drop-off" portion and the weight of the drill string is again dropped onto the drill holder to produce a suitable impact.

Any suitable type of rotary drill may be attached to the drill holder to effect drilling the well bore.

BRIEF DESCRIPTION OF THE DRAWINGS

FIG. 1 is a vertical sectional view of the impact device of the present invention;

FIG. 2 is an enlarged horizontal sectional view, taken on the line 2—2 of FIG. 1;

FIG. 3 is a perspective view, partly in section, of the slip clutch cam stabilizer assembly;

FIG. 4 is a perspective view, partly in section, of the lower cam assembly;

FIG. 5 is an enlarged perspective view showing the dovetail joint on the end face of an impact cam;

FIG. 6 is a perspective view, illustrating the camming surfaces on the end face opposite to that shown in FIG. 5.

DESCRIPTION OF A PREFERRED EMBODIMENT

In FIG. 1, numeral 2 designates the lowermost element of a drill string extending upwardly in a drill bore and having a tapered threaded socket 4 at its lower end. The sub assembly of the present invention is designated generally by numeral 6 and comprises a driving member 8 having tapered threads 10 engageable with the tapered threads 4 of the drill string so that the driving member becomes a rigid extension of the drill string. The sub assembly comprises an upper or stabilizer sleeve 12 having radial vanes 14 extending outwardly therefrom and provided with suitable friction portions 15 to engage the walls of a well bore to resist rotation of the sleeve 12. As shown, the sleeve 12 has upwardly facing shoulders 16 and 18 abutting corresponding downwardly facing shoulders on the driving member 8 and a suitable O-ring seal 20 is provided at the upper end of the stabilizer sleeve 12. A shroud cylinder 22 is threaded to the lower end of the stabilizer sleeve and is sealed thereto by an O-ring seal 24.

At its lower end the driving member 8 is provided with longitudinal splines 16 cooperating with mating splines 28 on a drill holder 30. The drill holder comprises an upper portion 32 having an O-rig seal 34 engaging the inner surface of the shroud cylinder 22 and also having a cam 36 fixed thereto. The cam 36 will be referred to hereinafter as a second cam.

The drill holder also includes a lower portion 38 having a tapered threaded socket 40 at its lower end by which any suitable drill bit structure 42 may be secured thereon. The lower portion 38 threadedly engages the upper portion 32 of the drill bit holder and is counterbored to define a small chamber 44. A lock nut 46 is threaded to the lower end of the driving member 8 and is capable of vertical movement within the chamber 44 but the shoulder 48 on the upper portion 32 and the bottom surface of the chamber 44 serve as stops limiting vertical movement of the drill bit holder relative to the driving member 8. A first cam 50 is fixed to the bottom end of the upper portion 12 of the sub assembly, previously referred to as the stabilizer sleeve, and that cam is in position to face and engage with the cam 36 previously described. Both the stabilizer sleeve 12 and the upper portion 32 of the drill bit holder are in the form of tubular elements coaxially arranged about the shank of the driving member 8.

FIGS. 3-6 more clearly show the structure of the cams 36 and 50 and the manner in which they are mounted on the respective supports. Each of the tubular members 12 and 32 is provided with a transverse dovetailed slot 52 and the cams 50 and 36 are provided with dovetailed ribs 54 engageable therewith whereby the cams may be selectively removed and replaced by other cams if and when necessary or desirable. The cams 36 and 50 are identical to each other and each includes diametrically opposed camming portions 56 mutually engageable with those of the other cam to effect relative reciprocation of the cams during relative rotation thereof.

As will be obvious, rotation of the drill string 2 will cause the driving member 8 to rotate also and will drive the drill bit holder 38 and a drill bit 42 in rotation in the usual manner. However, the stabilizer sleeve 12 engages the sidewalls of the well bore to resist or prevent rotation thereof and thus hold first cam 50 against rotation. The second cam 36, however, is fixed to the upper end of the drill bit holder and thus rotates with the drill string and relative rotation between those cams will periodically cause the stabilizer sleeve to rise, since the drill bit rests on the bottom of the well, and through shoulders 16 and 18 an upward force is applied to the driving member 8 and drill string 2. That upward force is sufficient to relieve the bit of some of the weight of the drill string and when the cams rotate relative to each other sufficiently for the camming portion 56 to drop off each other, a downward impact is applied to the drill to facilitate drilling the earth formation.

As is known, a length of drill string comprising several of the drill string elements 2 is quite heavy and some elastic stretching takes place as the drill string extends down into a well bore. That stretching or elastic deformation is relieved by the camming arrangement described but no appreciable force is transmitted to the top of the well and thus no vibrations occur at the well head. The present invention may also be used as a mill to mill debris or other unwanted objects in the bottom of a well and will reduce time and cost compared to present methods of removing such materials.

It is to be noted that the chamber 44 previously described is of sufficient longitudinal extent to permit the lock nut 46 to reciprocate vertically therein a distance at least equal to the rise of the camming portions 56 of cams 36 and 50.

Pumping action takes place within shroud cylinder 22, when cams 36 and 50 reciprocate relative to each other. Vent openings (not shown) are provided to permit flow of drilling fluid to provide lubrication between relatively movable parts.

While a single specific embodiment of the invention has been shown and described herein, the same is merely illustrative of the principles involved and other forms may be employed within the scope of the appended claims.

I claim:

1. An impact cam sub assembly for drill strings comprising:

a driving member adapted to be attached to a drill string to be rotated thereby;

a drill holder longitudinally slidable on the lower end of said driving member but non-rotatable relative thereto;

a stabilizer sleeve rotatable about the upper portion of said driving member and having means thereon engageable with the sides of a well bore for resisting rotation of said stabilizer sleeve when said driving member rotates;

interchangeable substantially identical cams, one of which is fixed to said stabilizer sleeve, and the second cam fixed to said drill holder and cooperating with said first cam to longitudinally reciprocate said stabilizer sleeve and drill holder relative to each other; and cooperating shoulders on said driving member and stabilizer sleeve arranged to exert an upward thrust on said driving member and drill string upon upward movement of said stabilizer sleeve relative to said drill holder.

2. A sub assembly as defined in claim 1 wherein said first and second cams are configured to relatively gradually lift said stabilizer sleeve relative to said drill holder then to abruptly drop the same.

3. A sub assembly as defined in claim 1 including means limiting relative longitudinal movement of said drill holder relative to said driving member in each direction.

4. A sub assembly as defined in claim 1 wherein interengaging splines on said drill holder and driving member permit relative longitudinal movement while preventing relative rotation.

5. A sub assembly as defined in claim 1 wherein said stabilizer sleeve and said drill holder comprise coaxial tubular structures embracing said driving member and each having a diametrically extending dovetail slot in its end confronting the other, said first and second cams being of substantially identical shape and interchangeable, each having a dovetail rib engageable in a selected dovetail slot.

6. The cam subassembly of claim 1, wherein said means for resisting rotation of said stabilizer sleeve are radial vanes substantially configured in the form of a truncated pyramid.

7. The sub assembly of claim 6, wherein the outer surface of each of said radial vanes is provided with friction means to better engage the walls of a well bore.

* * * * *